United States Patent [19]

Plemitscher

[11] 4,037,334

[45] July 26, 1977

[54] DRIVE MEANS FOR AN ELEVATING SCRAPER ELEVATOR

[75] Inventor: Robert Antone Plemitscher, Dubuque, Iowa

[73] Assignee: Deere & Company, Moline, Ill.

[21] Appl. No.: 688,673

[22] Filed: May 21, 1976

[51] Int. Cl.[2] ..... B60P 1/36

[52] U.S. Cl. ..... 37/8; 198/834; 198/854

[58] Field of Search ..... 37/8; 198/834, 854

[56] References Cited

U.S. PATENT DOCUMENTS

| | | | |
|---|---|---|---|
| 2,736,209 | 2/1956 | Christian | 198/854 X |
| 3,376,758 | 4/1968 | MacKay | 198/854 X |
| 3,557,473 | 1/1971 | Grossklaus et al. | 37/8 |
| 3,559,312 | 2/1971 | Fox et al. | 37/8 |
| 3,668,794 | 6/1972 | Marquardt | 198/854 X |
| 3,738,031 | 6/1973 | Lott | 37/8 |
| 3,748,759 | 7/1973 | Liess | 37/8 |
| 3,758,966 | 9/1973 | Miller | 37/8 |

FOREIGN PATENT DOCUMENTS

| | | | |
|---|---|---|---|
| 712,443 | 6/1965 | Canada | 198/854 |

*Primary Examiner*—E. H. Eickholt

[57] ABSTRACT

An elevating scraper elevator includes a main frame having drive and idler sprockets mounted at its opposite ends and an endless conveyor passing about the frame and meshed with the drive and idler sprockets. The drive sprockets are fixed to opposite end portions of a tubular drive shaft section which is rotatably mounted on the main frame. Projecting axially into the tubular drive shaft section is a solid drive shaft section having one end fixed to the interior of the tubular drive shaft section and having its other end connected to the output shaft of a motor and gear reduction means that is supported by the main frame.

3 Claims, 3 Drawing Figures

DRIVE MEANS FOR AN ELEVATING SCRAPER ELEVATOR

BACKGROUND OF THE INVENTION

The present invention relates to an elevating scraper elevator and more particularly relates to means for driving the conveyor of the elevator.

Elevators for elevating scrapers normally include a support frame having a drive shaft rotatably supported at an upper end thereof. A pair of drive sprockets are normally fixed to opposite end portions of the drive shaft and are respectively meshed with a pair of endless roller chains forming opposite side portions of the elevator.

In order to prevent undue wear of the drive sprocket and the chains, the drive sprockets have an uneven number of teeth which require them to be timed with each other so as to prevent the chain from jumping teeth and damaging the elevator. Heretofore, the timing of the drive sprockets have been maintained through the use of a relatively stiff drive shaft. However, when such a drive shaft is used, high shock loads applied thereto are often transferred through the drive train to the motor for driving the shaft.

SUMMARY OF THE INVENTION

According to the present invention, there is provided an improved elevating scraper elevator and more particularly there is provided an improved drive means for the drive sprockets of such an elevator.

A broad object of the invention is to provide an elevator drive means which will maintain the timing of the drive sprockets while at the same time absorbing shock loads and delivering the loads to the remainder of the drive train in a more even manner.

A more specific object of the invention is to provide a compact drive shaft assembly including a relatively stiff, hollow shaft section and a somewhat flexible solid shaft section, the solid shaft section being located centrally within the hollow shaft section and having its opposite ends fixed to the hollow shaft section and an output shaft from a combined motor and gear reduction assembly.

These and other objects will become apparent from a reading of the following description in conjunction with the appended drawings.

DESCRIPTION OF THE PREFERRED EMBODIMENT

Figure 1:
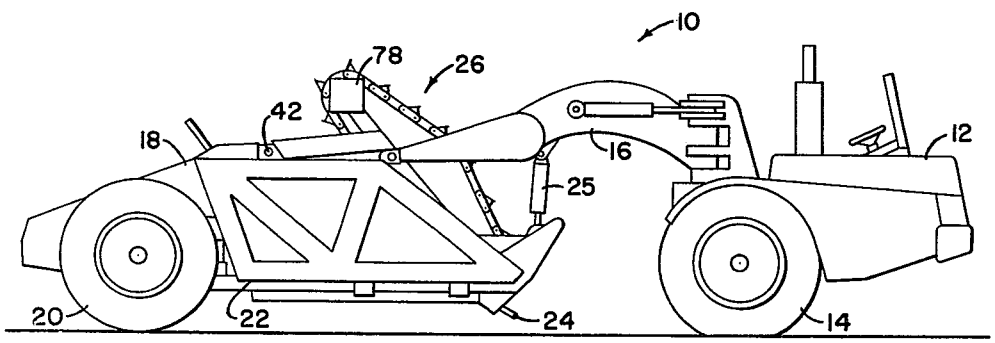
FIG. 1 is an overall right side elevational view of an elevating scraper of the type with which the present invention is particularly adapted for use.

Referring now to FIG. 1, therein is shown an elevating scraper indicated in its entirety by the reference numeral 10. The scraper 10 is of a conventional type including a front tractor section 12 supported on a pair of drive wheels 14 and coupled, through means of a goose neck structure 16, to a rear trailer section 18 that is supported on rear ground wheels 20. The trailer section 18 is comprised mainly of a bowl 22 for receiving earth cut by a leading cutting edge 24 when the traction section 12 is driven forwardly and the cutting edge 24 is lowered to a cutting position through means of hydraulic actuator means mounted, as at 25, between the goose neck and the bowl. Positioned at the forward end of the bowl 22 for aiding in loading the bowl with material cut by the cutting edge 24 is a conveyor indicated generally at 26.

Figure 2:
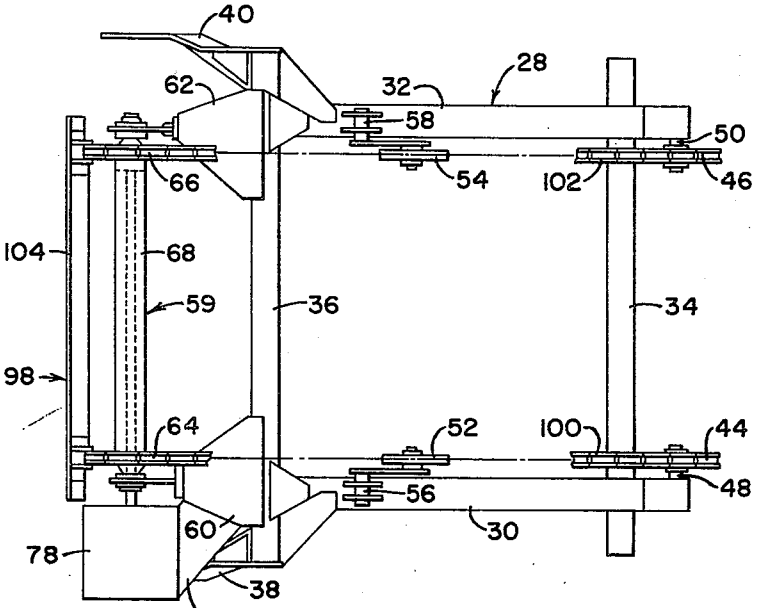
FIG. 2 is a somewhat schematic top plan of an elevator embodying a drive means constructed according to the principles of the present invention.
Figure 3:
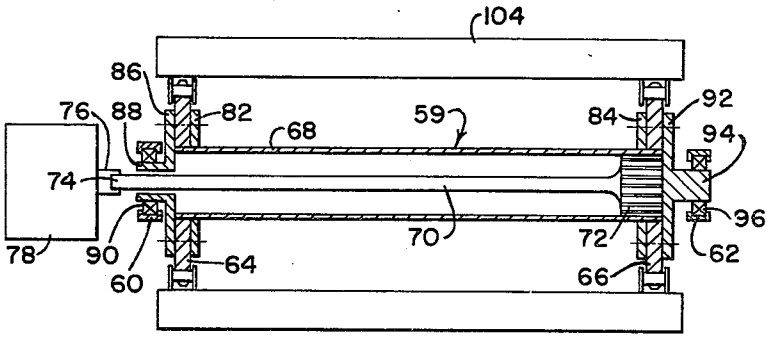
FIG. 3 is a view, partially in vertical section, showing the drive shaft assembly of the present invention.

Turning now to FIG. 2, it can be seen that the conveyor 26 includes a main frame 28 comprising, as viewed from the rear of the vehicle 10, parallel right and left side members 30 and 32, respectively, joined to each other by front and rear cross members 34 and 36, respectively. Secured to the rear crossbar 36 and extending rearwardly therefrom are right and left mounting arms 38 and 40 having their rearward ends connected to the bowl 22 for vertical swinging movement about a horizontal transverse axis located at 42.

Right and left idler sprockets 34 and 36, respectively, are mounted in axial alignment with each other through means of right and left stub shafts 48 and 50, respectively, fixed to the forward ends of the side members 30 and 32. Respectively mounted on the side members 30 and 32 intermediate the forward and rearward ends thereof are right and left idler rollers 52 and 54 which are respectively mounted as at 56 and 58 for vertical adjustement in a conventional manner (not shown). Supported at the rear end of the frame 28, through means including a drive shaft assembly 59 and right and left support members 60 and 62, respectively, are right and left drive sprockets 64 and 66, respectively.

More specifically, the drive shaft assembly 59 includes a relatively torsionally stiff tubular shaft section 68 having a solid torsionally flexible shaft section 70 positioned axially therein and projecting from the right end thereof. The solid shaft section 70 has an enlarged left end 72 splined to the left inner end portion of the tubular shaft section 68 and has a right end coupled as at 74 to an output shaft 76 emanating from a motor and gear box schematically shown at 68 and supported from the right end of the rear cross member 36 through means of a support member 80. Right and left circular flanges 82 and 84 are respectively fixed to the tubular shaft section 68 at locations spaced inwardly from the right and left ends of the shaft sections 68. The right drive sprocket 64 is sandwiched between the outside of the right flange 82 and the inside of a hub 86 forming part of a hollow stub shaft 88 which is rotatably supported in the right support member 60 through means of bearings 90. A plurality of bolts (not shown) fix the drive sprocket 64, flange 82, and stub shaft 88 together. Similarly, the left drive sprocket 66 is sandwiched between the outer surface of the left flange 84 and the inner surface of a hub 92 forming part of a stub shaft 94 mounted for rotation in the left support 62 by means of a bearing 96.

A conveyor 98 extends about the frame 28 and includes right and left endless roller-type drive chains 100 and 102, respectively trained about the right idler sprocket 44, the right idler roller 52, and the right drive sprocket 64 and trained about the left idler sprocket 46, the left idler roller 54 and the left drive sprocket 66. A plurality of conveyor flights 104 (only of which is shown) extend transversely between and are secured to the drive chains 100 and 102.

The operation of the conveyor drive is briefly as follows. Power developed by the motor housed in the motor and gearbox 78 is delivered to the output shaft 76 and flows from there through the solid shaft section 70, the splined connection of the shaft 70 with the tubular shaft section 68 and through the shaft section 68 to the drive sprockets 64 and 66 and then to the chains 100 and 102. The tubular shaft section 68 has sufficient torsional stiffness to maintain the drive sprockets 64 and 66 in time with each other. Thus, if impact loads are delivered to the tubular shaft section 60 via the conveyor 98 and one or the other or both of the sprockets 62 and 64, the load will be transferred to one end of the solid shaft section 70. The solid shaft section 70 exhibits sufficient torsional flexibility to allow it to "wind-up" so as to absorb the shock load, the shaft 70 once wound up acting to slowly release the stored energy so as to prevent the shock from being transferred through the drive train to the motor in the housing 78.

Thus, it will be appreciated that the applicant has provided a simple, compact design for overcoming undesirably shock loading of the reduction gear train while at the same time retaining the feature present in the prior of maintaining the drive sprockets in time with each other.

I claim:

1. In an elevating scraper elevator of a type including a main frame rotatably supporting at least one pair each of drive and idler sprockets at longitudinally spaced locations thereof and an endless conveyor trained about the drive and driven sprockets, the improvement comprising: said pair of drive sprockets being fixed to opposite first and second end portions of a relatively torsionally stiff hollow drive shaft section; said hollow drive shaft section having its opposite ends rotatably mounted on the main frame; a relatively torsionally flexible second drive shaft section located centrally within the hollow drive shaft and having opposite first and second ends of which the first end is located adjacent to the first end portion of the hollow drive shaft and the second end 16 located adjacent to and is fixed to the second end portion of the hollow drive shaft and forms the sole connection between the first and second drive shaft sections; and drive input means mounted on the main frame and drivingly coupled to the first end of the second drive shaft section.

2. In an elevating scraper elevator of a type including an endless flexible conveyor member engaged with and trained about drive and idler sprockets rotatably supported on a frame, and improved drive for the drive sprockets comprising: a gear box supported by the frame and having an output shaft projecting therefrom along an axis extending centrally through an adjacent first and a remote second drive sprocket; a relatively torsionally flexible first drive shaft section disposed along said axis and having a first end fixed to said output shaft and a second end located in the vicinity of the remote drive sprocket; a relatively torsionally stiff tubular second drive shaft section mounted concentrically relative to said first drive shaft section and having first and second end portions respectively fixed to said adjacent and remote drive sprockets and rotatably supported on said frame; and the second end of said first drive shaft section being fixed to the second drive shaft section adjacent the second end portion of the latter to form the sole connection between the first and second drive shaft sections.

3. An elevating scraper elevator, comprising; a support frame having opposite first and second ends, a relatively torsionally stiff tubular first drive shaft section rotatably supported on the frame adjacent the first end thereof; at least a pair of drive sprockets fixed to the first drive shaft section respectively adjacent opposite first and second ends thereof for rotation therewith; a pair of idler sprockets rotatably supported on the frame adjacent the second end thereof respectively in alignment with the pair of drive sprockets; an endless conveyor trained about the drive and idler sprockets; a relatively torsionally flexible second drive shaft section disposed axially inside the first drive shaft section and having first and second ends, the second end being fixed to the first drive shaft section adjacent the second end of the latter and forming the sole connection between the first and second drive shaft sections and the first end of the second drive shaft section projecting outwardly from the first end of the first drive shaft section; and motor means fixed to the frame exclusive of the first and second shaft sections and having an output shaft fixed to the first end of the second drive shaft section.

* * * * *